United States Patent [19]

Kreuz et al.

[11] Patent Number: 4,858,892

[45] Date of Patent: Aug. 22, 1989

[54] DEVICE FOR DETERMINING THE CHARGE PROFILE IN A SHAFT FURNACE

[76] Inventors: Hans-Otto Kreuz, Fortunastrasse 9 D-5901 Wilnsdorf, Fed. Rep. of Germany; Hans Jochen Grisse, Eiserntalstrasse 451, D-5900 Siegen, Fed. Rep. of Germany

[21] Appl. No.: 184,877

[22] Filed: Apr. 22, 1988

[30] Foreign Application Priority Data

May 12, 1987 [DE] Fed. Rep. of Germany ..... 3715762

[51] Int. Cl.[4] ..... C21B 7/24

[52] U.S. Cl. ..... 266/99; 266/92

[58] Field of Search ..... 266/92, 99, 93, 94; 342/124

[56] References Cited

U.S. PATENT DOCUMENTS

| | | | |
|---|---|---|---|
| 4,219,814 | 8/1980 | Johnson | 342/124 |
| 4,290,067 | 9/1981 | Legille et al. | 266/92 |
| 4,332,374 | 6/1982 | Kremer | 266/99 |

FOREIGN PATENT DOCUMENTS

| | | | |
|---|---|---|---|
| 0017664 | 10/1980 | European Pat. Off. | 266/92 |
| 3233986 | 3/1984 | Fed. Rep. of Germany . | |
| 2141844 | 1/1973 | France | 342/124 |

*Primary Examiner*—S. Kastler

*Attorney, Agent, or Firm*—Young & Thompson

[57] ABSTRACT

Device for determining the charge profile in a shaft furnace. In order to be able to scan the entire burden surface at least over a right-angle graticule, a radar unit is arranged at the front end of a tubular lance, which latter can be radially introduced into the furnace, the beam direction of this radar unit being pivotable about the longitudinal axis of the tubular lance bilaterally over a predetermined angle, as well as about a transverse axis extending perpendicularly thereto, approximately by the same angle in the forward direction. The device is suitable for scanning the entire burden surface in a graticule mode as well as line-by-line, and the scanning results of the device can be made visible and can also be used as input data for the automatic control of the shaft furnace.

4 Claims, 3 Drawing Sheets

DEVICE FOR DETERMINING THE CHARGE PROFILE IN A SHAFT FURNACE

The invention relates to a device for determining the charge profile in a shaft furnace.

Accurate knowledge of the burden surface profile is important, inter alia, for optimum operation of a shaft furnace, especially a blast furnace; in particular, with a view toward automatization of large-scale blast furnaces, an evaluation of this knowledge satisfying a given situation must be possible with the objective of obtaining a maximally uniform charging of the furnace and a reproducible surface profile of the burden.

DOS 3,233,986 shows a device of this type for determining the burden profile in a shaft furnace wherein a plumb weight with a measuring head is provided attached to a string extending in the tubular lance. This reference also discusses the disadvantages of purely mechanical scanning of the burden surface, for example penetration into the burden charge, thereby alteration of the latter, slipping off from inclined slopes on the burden surface, thus falsification of the surface image. Although the device according to DOS 3,233,986 avoids these drawbacks, scanning can in all cases be performed only over a radius so that a topography of the total surface of the burden is not obtained. For that purpose, several probes would have to be introduced at angles to one another.

A pivotable radar probe has been known from EP 0 017 664 which is introduced perpendicularly into the furnace at the port end and, in the introduced position, can be pivoted over a limited angular range about the axis of the inserted tubular lance. However, this device also leaves unscanned surface regions. The scanned zone is practically merely a ring segment of a fixed width. Another disadvantage is constituted by the constantly varying angles of impingement upon the burden surface, leading to a distorted image of the surface since the device on account of the furnace charging unit must be arranged in the port end strongly eccentrically with respect to the furnace center so that a certain symmetry is lacking for the evaluation.

The invention is based on the object of providing a device of the type discussed hereinabove, making it possible to obtain an unfalsified image of the entire burden surface profile leading itself readily to computer graphics.

This object has been attained by the characterizing features of claim 1. Suitable further developments can be derived from the dependent claims.

The drawing illustrates one embodiment of the invention. In the drawing.

Figures 1, 2:
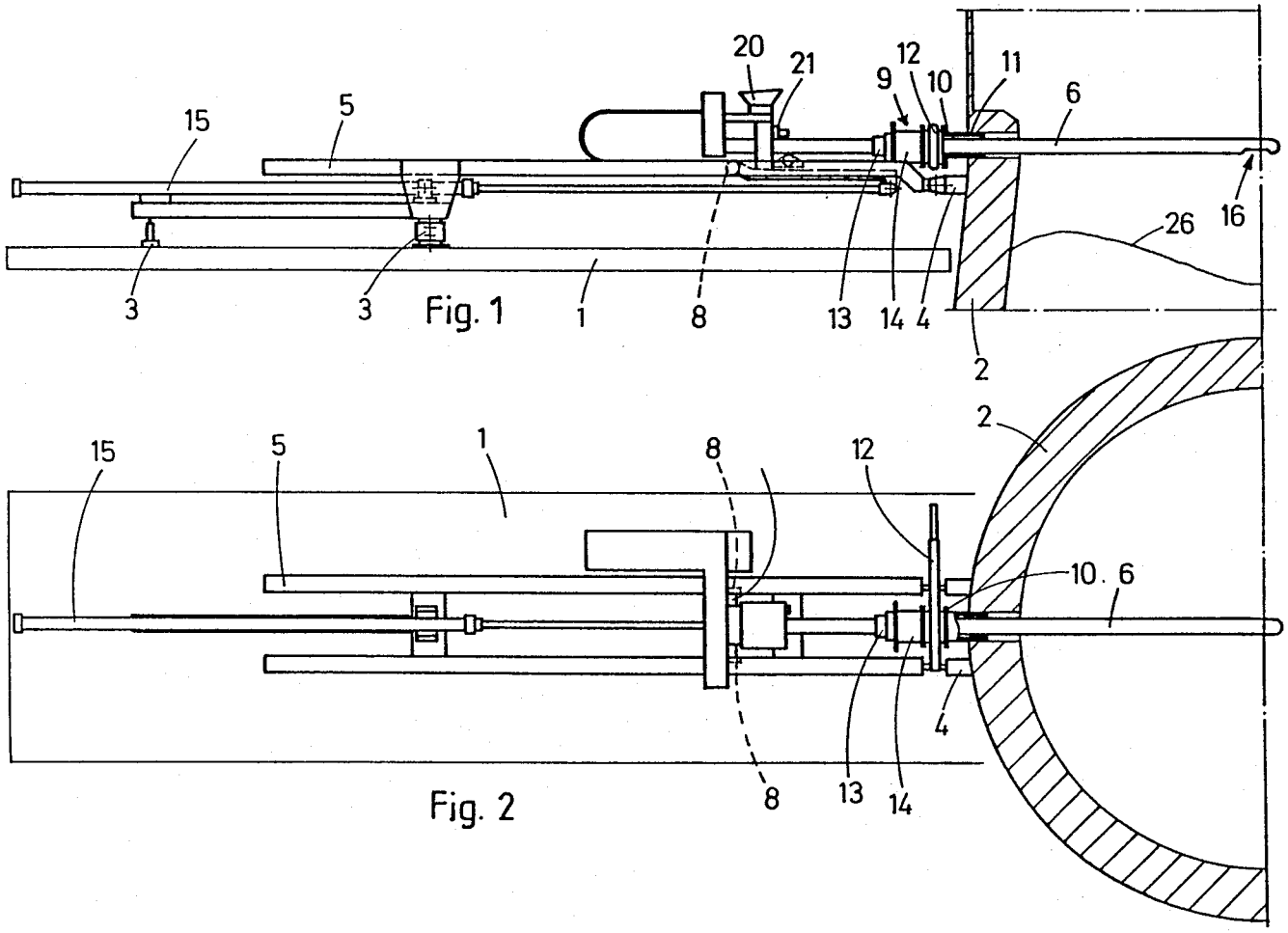
FIG. 1 shows a lateral view of the device.
FIG. 2 shows a top view thereof.
Figure 4:
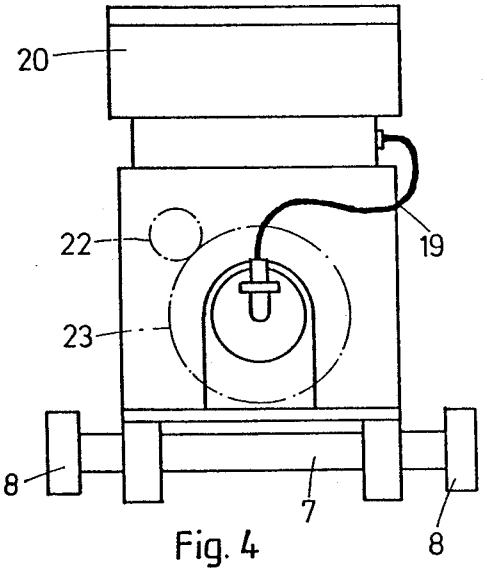
FIG. 4 shows a view in the direction of arrow IV in FIG. 3, and FIGS. 5–7 show schematically the scanning procedure in three different views.
Figure 3:
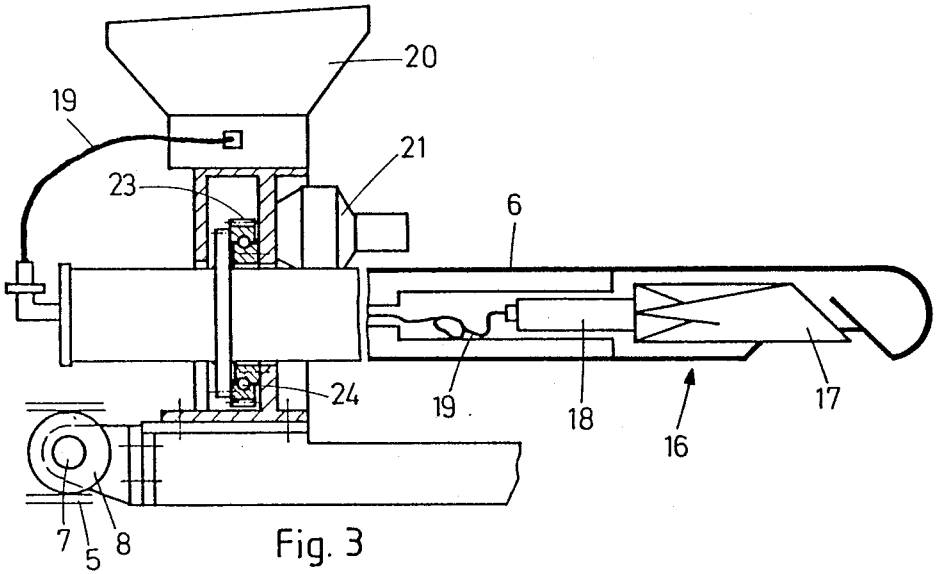
FIG. 3 shows a lateral view, enlarged as compared with FIG. 1, of the forward and rearward portions of the device.

A frame 5 with a tubular lance 6 rests on supports 3, on the one hand, as well as on a bracket 4 at the blast furnace 2, on the other hand, on a platform 1 at a blast furnace 2, of which only one half of the port end is illustrated; the tubular lance is displaceably guided in the frame 5 by way of a crosshead 7 with rollers 8. A pipe section with a flange 10 and a bearing bush 11 is arranged at the blast furnace 2 as the lance lead-through 9. The flange 10 is equipped with a shutoff slide 12, a gasket 13 and an adapter 14.

The tubular lance 6 is displaced in the frame 5, for example, with the aid of a pressure medium cylinder 15. The front end of the lance houses a radar unit 16 with an antenna 17 and a radar head 18 connected via a cable 19 to a control box 20. The tubular lance 6 can be pivoted by means of a motor 21 via a pinion 22 and a gear wheel 23 in a bearing 24 about its longitudinal axis by an angle alpha toward both sides of the perpendicular plane 25 extending through the longitudinal axis (see FIG. 6) so that upon insertion of the tubular lance 6 in the furnace 2 the burden surface 26 is scanned by the pivotal motions of the lance. The surface profile is visualized on a screen or recorded topographically and can also be used as input data for the automatic blast furnace control.

Figure 6:
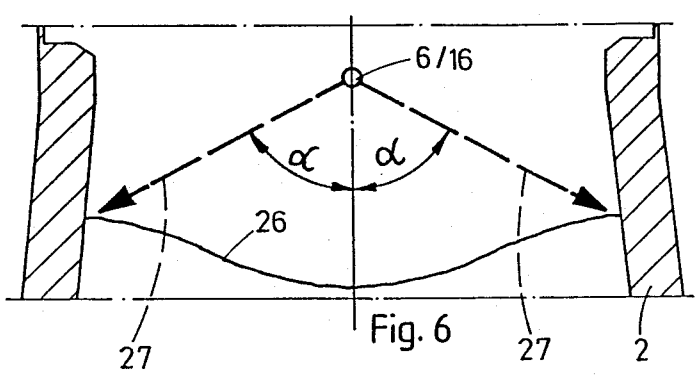
Figure 5:
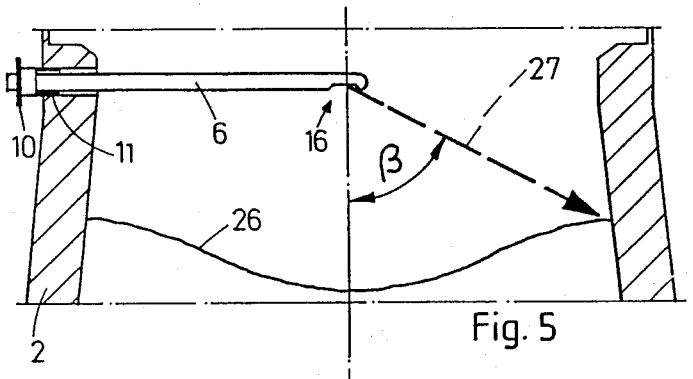
Figure 7:
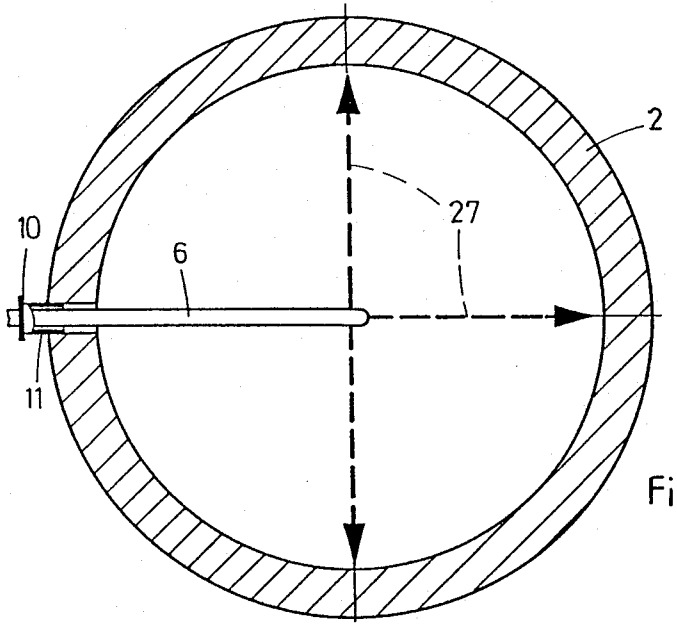

This scanning possibility extends into the center of furnace 2. In order to scan also the half of the burden surface lying in front of the lance end, the radar head 18 or the antenna 17 is swung forwards gradually to an angle beta (see FIG. 5) in addition to the pivoting motion alpha of the tubular lance 6, so that the profile of the entire burden surface 26 is covered. The dashed-line arrows 27 in FIGS. 5–7 show the radar beam directions in the outermost pivoting positions. Under practical circumstances, it will be sufficient in any cases to scan the burden surface along a right-angle "graticule", i.e. the tubular lance 6 is initially introduced up into the center of furnace 2 with the radar beam being oriented perpendicularly downwardly; during this step, a radius is being scanned. Then, it is possible to scan either the extension of this radius up to the total diameter by pivoting over the angle beta and, after resetting of this pivotal motion, the diameter extending perpendicularly to the first-mentioned diameter by pivoting over the angles alpha toward the right and toward the left; or the lateral pivoting over alpha takes place prior to pivoting the radar beam toward the front over beta.

Instead of executing the pivotal motions over the angles alpha by rotating the entire tubular lance 6, the arrangement can also be such that the pivoting movements over alpha as well as those over beta are performed by pivoting the radar antenna 17 by itself into the corresponding directions, as indicated by arrows 27 in FIGS. 5–7. The drive mechanism or mechanisms for the radar antenna 17 is, or are, not illustrated.

We claim:

1. Device for determining the charge profile in a shaft furnace with a measuring unit which is introduced radially into the furnace by way of a tubular lance and scans the surface of the charge material in a noncontact fashion, comprising a radar unit (16) at the front end of the tubular lance (6), means for pivoting the beam direction (27) of this radar unit about the longitudinal axis of the tubular lance (6) bilaterally over an angle (alpha), and means for pivoting said beam direction (27) as well about a transverse axis extending perpendicularly thereto in the forward direction over an angle (beta) during projection of the beam.

2. Device according to claim 1, wherein the tubular device (6) is mounted to be pivotable about its longitudinal axis, and that the drive mechanism for pivoting the beam orientation (27) in the forward direction (angle beta) is located in the radar head (18) or, respectively, at the tubular lance (6).

3. Device according to claim 1, wherein both drive mechanisms for both pivotal motions are located in the radar head (18) or, respectively, at the tubular lance (6).

4. Device according to claim 1, wherein only the antenna (17) of the radar unit (16) is pivotable.

* * * * *